United States Patent [19]

Best

[11] 4,426,792

[45] Jan. 24, 1984

[54] HIGH TURBULANCE HEAT TRANSFER OVEN

[76] Inventor: Willie H. Best, 18C The Heritage, Columbia, S.C. 29201

[21] Appl. No.: 282,531

[22] Filed: Jul. 13, 1981

Related U.S. Application Data

[60] Division of Ser. No. 916,214, Jun. 16, 1978, Pat. No. 4,235,023, and a continuation of Ser. No. 104,339, Dec. 17, 1979, abandoned.

[51] Int. Cl.[3] ..... F26B 3/04

[52] U.S. Cl. ..... 34/28; 34/212; 34/216; 34/225; 34/54

[58] Field of Search ..... 34/212, 213, 214, 215, 34/216, 217, 225, 233, 48, 54, 29, 31, 34, 28; 432/144, 152, 176

[56] References Cited

U.S. PATENT DOCUMENTS

| | | | |
|---|---|---|---|
| 2,262,057 | 11/1941 | Shaw | 34/215 |
| 2,376,174 | 5/1945 | Munning et al. | 34/213 |
| 2,790,250 | 4/1957 | Giroud | 34/213 |
| 4,235,023 | 11/1980 | Best | 34/48 |

*Primary Examiner*—Larry I. Schwartz

*Attorney, Agent, or Firm*—Newton, Hopkins & Ormsby

[57] ABSTRACT

A housing having propeller type fans in the housing adjacent to an object or objects to be dried. Shafts, carried by sleeves projecting through the side walls or top wall, rotate the fans. Motors externally of the housing drive the shafts.

In one form of the invention, the air circulated by the fans is heated by steam coils adjacent to the periphery of the blades of the fans. In another embodiment, an open flame gas or oil burner, disposed in a combustion chamber, heats air, which is subsequently directed by ducts to the fans. Exhaust blowers and exhaust ducts exhaust the fume laden air from the chamber. Still another embodiment shows pairs of juxtaposed oppositely blowing fans carried by shafts protruding through the walls of the oven and spaced heaters between the fans. Still another embodiment shows opposed fans for drying a cylindrical member passed through the chamber.

17 Claims, 24 Drawing Figures

HIGH TURBULANCE HEAT TRANSFER OVEN

This is a continuation of application Ser. No. 104,339, filed Dec. 17, 1979, now abandoned, and a division of application Ser. No. 916,214, filed June 16, 1978, now U.S. Pat. No. 4,235,023.

BACKGROUND OF THE INVENTION

1. Field of the Invention

This invention relates to an apparatus and process for heating and drying objects and is more particularly concerned with a forced convection heat transfer oven through which objects are passed for drying and in which heated air is circulated.

2. Description of the Prior Art

In the past ovens have been used to dry paint and other coatings on appliances, furniture and automobile bodies and other objects and articles of manufacture. In some instances electric and gas fired infra red heaters have been used for the heat source in these ovens. Other ovens have used air as the heat transfer medium with little or no turbulence generated around the object to be heated (free convection oven). Other ovens have employed turbulent air or air that is discharged at relative high velocity. In previous applications where turbulent air was used it has been necessary to develop static pressures by the use of centrifugal fans in order to develop the relative high discharge velocity required. This method of generating turbulence requires large horse power.

Exhaust fans are also quite common where painting is being done to remove the fumes of the paint and the air which carries the paint.

SUMMARY OF THE INVENTION

Briefly described, the present invention includes an apparatus, namely an oven having walls through which shafts, supported by fixed sleeves, project. Radially extending propeller blades are provided on the ends of the shafts. The blades are spaced from the walls and direct air toward the surface which is to be dried. In one embodiment, heat exchangers, which carry steam, are disposed on about the same plane as the blades so as to heat the air passing to the back side of the blades. Another embodiment shows the fans in staggered relationship. Still another embodiment shows the fans operating in alternate directions and heaters between the fans so that the exhaust of one fan delivers air through the heater to the next fan.

Other embodiments teach gas fired heaters discharging to the back side of the fans and fixed within a duct for heating air delivered to the fans.

In operation, the apparatus of the present invention moves large volumes of air over the surfaces to be dried with no appreciable back pressure and with great efficiency in the use of power. The surfaces to be dried are thus heated quite rapidly. Since the air is not blown toward an entrance or exit opening through which the object passes, and air is exhausted from within the oven, there are no appreciable loses of heat to the interior of a factory and no appreciable contamination of the air in the factory. Thus, no appreciable sealing of the oven is necessary.

The oven can be quite readily and easily zoned both as to zones of different temperature and zones of different air velocity. The cost of producing and operating the oven is quite nominal since small motors are used as opposed to the large motors used by centrifugal blowers.

Accordingly, it is an object of the present invention to provide an apparatus for drying objects which is inexpensive to manufacture, durable in structure an efficient in operation.

Another object of the present invention is to provide an apparatus for drying objects which will dry a large volume of such objects quite rapidly and inexpensively.

Another object of the present invention is to provide a process by which a large number or volume of objects which have been coated or painted can be dried and at low cost.

Other objects features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figure 1A:
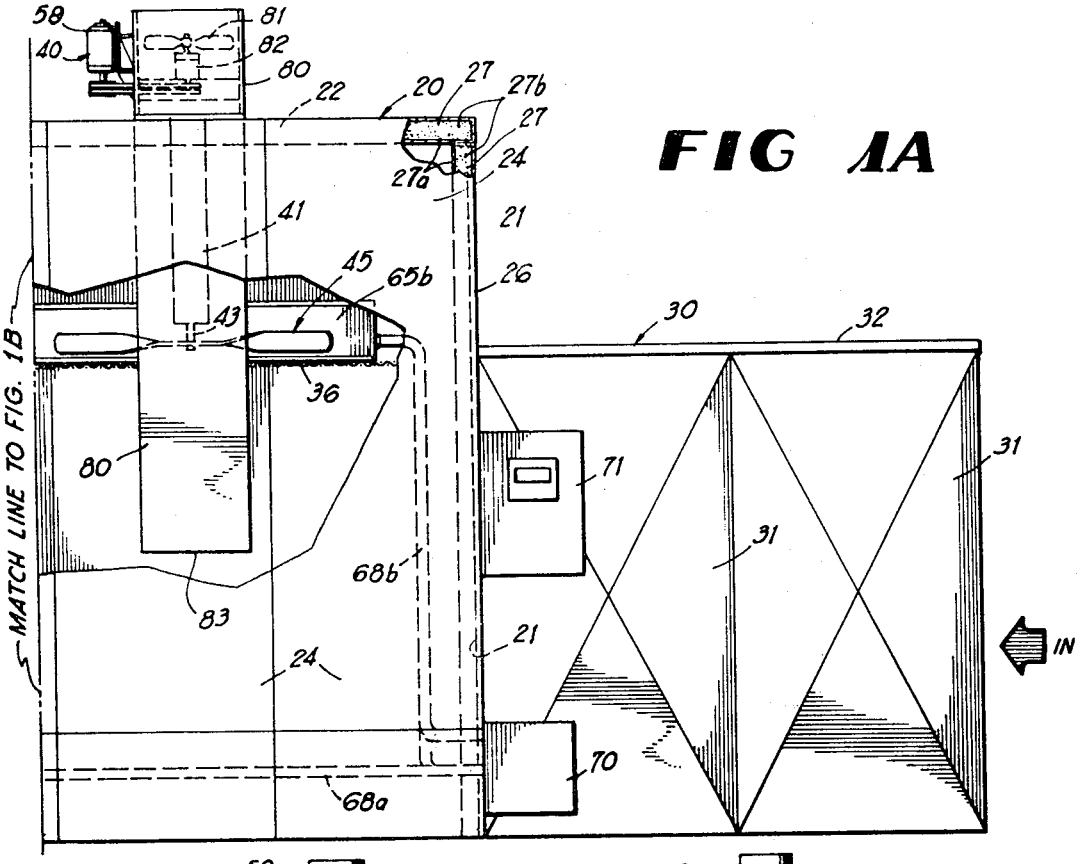
FIG. 1A is a side elevational view of a portion of one form of oven for drying the surfaces of objects, the oven being constructed in accordance with the present invention.
Figure 1B:
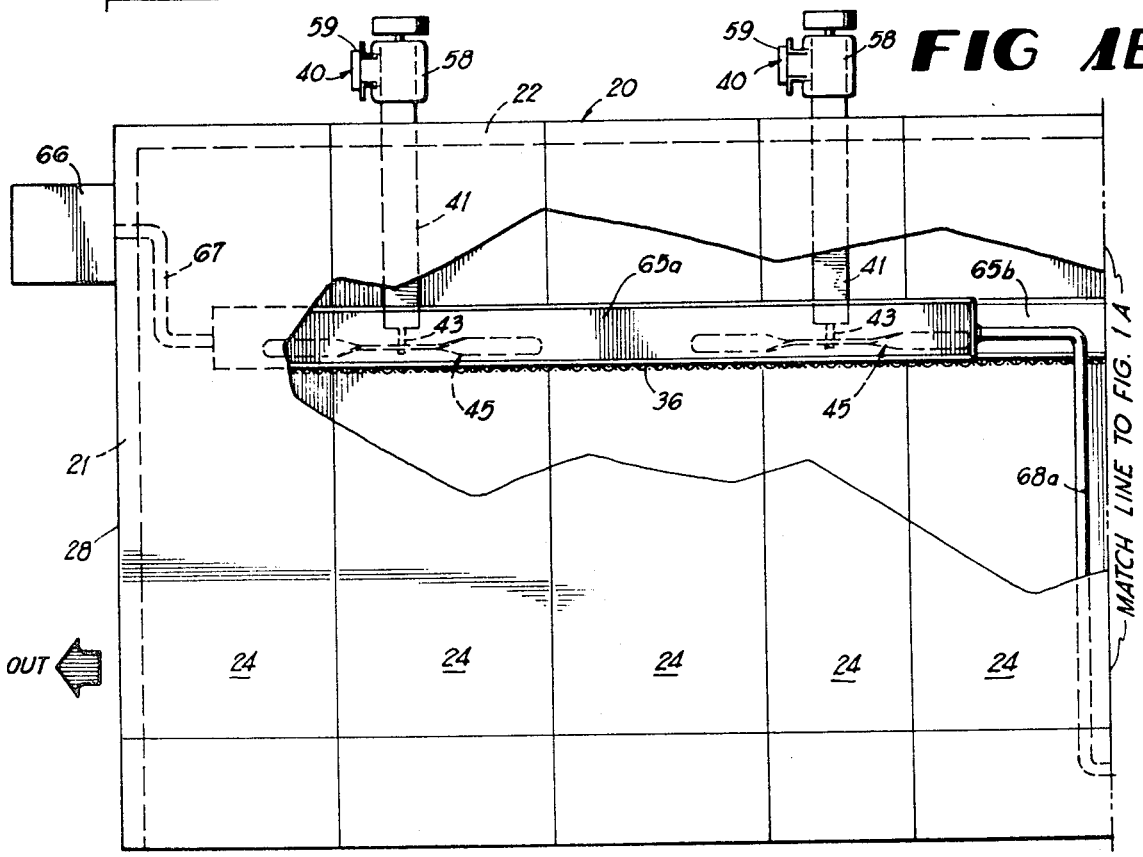
FIG. 1B is a side elevational view of the remainder of the oven shown in FIG. 1A.

Referring now in detail to the embodiments chosen for the purpose of illustrating the present invention, numeral 20, in FIGS. 1A, 1B, 2A, 2B and 3, denote generally an inverted U shaped or channel shaped, oven housing or casing. The housing 20 includes abutting side panels 24 secured side to side to form opposed, parallel side walls 21 while abutting top panels 25, secured together in side to side fashion form the top wall 22 of the oven. Each of panels 24 and 25 includes appropriate sheets of insuation 27 disposed within the interior of the panel and inner and outer metal sheets **27*a* and 27*b* sandwiching the insulation sheets 27**.

At the front end of the housing 20 there is an entrance vestibule, denoted generally by numeral 30. This entrance vestibule 30 is also an inverted U-shaped or channel shaped member but is of smaller dimensions than the housing 20. The vestibule 30 thus has abutting opposed parallel, rectangular, upright, side panels 31 resting by their lower edges on the floor and top panels 32 joining the upper edges of the side panels 31 to form a roof.

The housing 20 is provided with a front panel or wall 26 closing the front of housing 20, except for an access opening defined by inner edges of the panel 26. The inner edges of the vestibule 30 are connected to the inner edges of the panel 26 while the outer end of the vestibule 30 is open to provide a passageway through the vestibule 30 and into the larger housing 20.

The housing 20 also has a back panel or wall 28 which has an exit opening of the same dimensions as the access opening of panel 26. Thus, an unobstructed passageway 35 is provided through which successive objects 100, carried on a conveyor 85, are fed for drying by the oven.

According to the present invention, drying is accomplished by heated high velocity air driven by a plurality of fan assemblies 40 spaced successively along the pathway or passageway 35.

Figure 4:
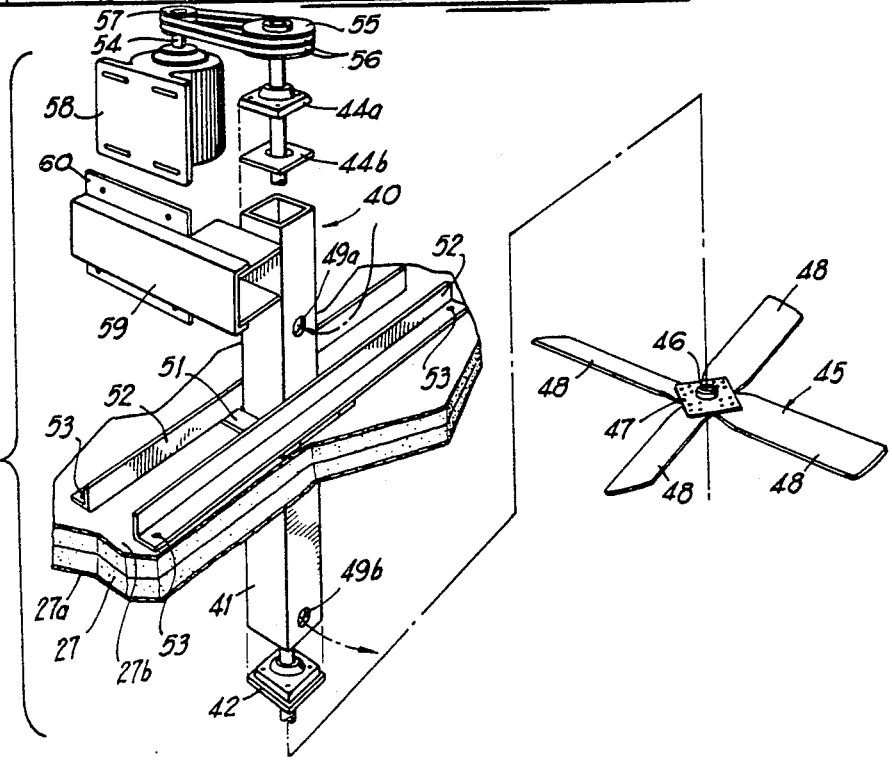
FIG. 4 is an exploded perspective view of one of the fan assemblies of the oven shown in FIGS. 1A, 1B, 2A, 2B and 3.

As best seen in FIG. 4, each fan assembly 40 includes a hollow rectangular or square tubular casing or sleeve 41, open at both ends. Secured within the inner end of the casing 41 is an inner or lower bearing 42 which journals a central drive shaft 43. Secured within the outer end of the casing 41 is an outer bearing aligned with inner bearing 42 and also receiving shaft 43. This outer bearing, as illustrated, is a thrust bearing, includes opposed bearing sections **44*a* and 44*b*. The lower or inner bearing 42 journals the shaft 43 for both rotational movement and axial movement whereby the shaft 43** may expand and contract with heat changes.

The shaft 43 extends inwardly beyond bearing 42 and its inner end is provided with a bladed air propeller, fan or impeller 45. The propeller 45 includes a central hub formed of a collar 46 secured to the end of the shaft 43 and a square hub plate 47. In the present embodiment four flat paddle like blades 48 radiate from the hub 47, each blade 48 being disposed at an angle to the shaft 43 to drive the air inwardly when shaft 43 is rotated in a counterclockwise direction as viewed in FIG. 4.

For cooling the shaft 43 and bearing 42, a pair of holes **49*a* and 49*b* are provided in the casing 41 respectively adjacent the bearing formed by segment 44*a*, 44*b* and bearing 42. The suction or aspirating effect created at its back side by fan 45 induces a flow of air as indicated by the arrows 50 in FIG. 4**.

The sleeve or casing 40 projects through an appropriate hole in panel 25 and is secured by an intermediate portion to one of the panels 25. For this purpose, the casing 41 has a central perimeteral flange 51 which abuts the outer surface of panel 25. Two opposed, angle iron, brackets or straps 52, passing on opposite sides of the casing 41 and respectively over opposite portions of flange 51, extend over ths surface of panel 25 and are secured by rivits or bolts 53, thereto. Thus, the casing 41 is disposed in a fixed position extending perpendicularly through the roof panel 25 and the hole **49*a* is disposed externally of the housing 20**.

The outer end of the shaft 43 is provided with a pulley or sheave 55 driven by belts 56 from a pulley or sheave 57 on the shaft 54 of an electric motor 58. A motor mounting bracket 59, secured to an outer surface of casing 41, extends laterally from the casing 41 and is provided, at its outer end portion, with a motor mounting plate 60. Bolts (not shown) mount motor 58 on plate 60 so as to dispose its shaft 54 parallel to and spaced from shaft 43. Thus, motor 58 is spaced away from and outwardly of panel 25. Also, the fan 45 is spaced an appreciable distance inward from the inner sheet **27*b* of panel 25**.

Figure 2A:
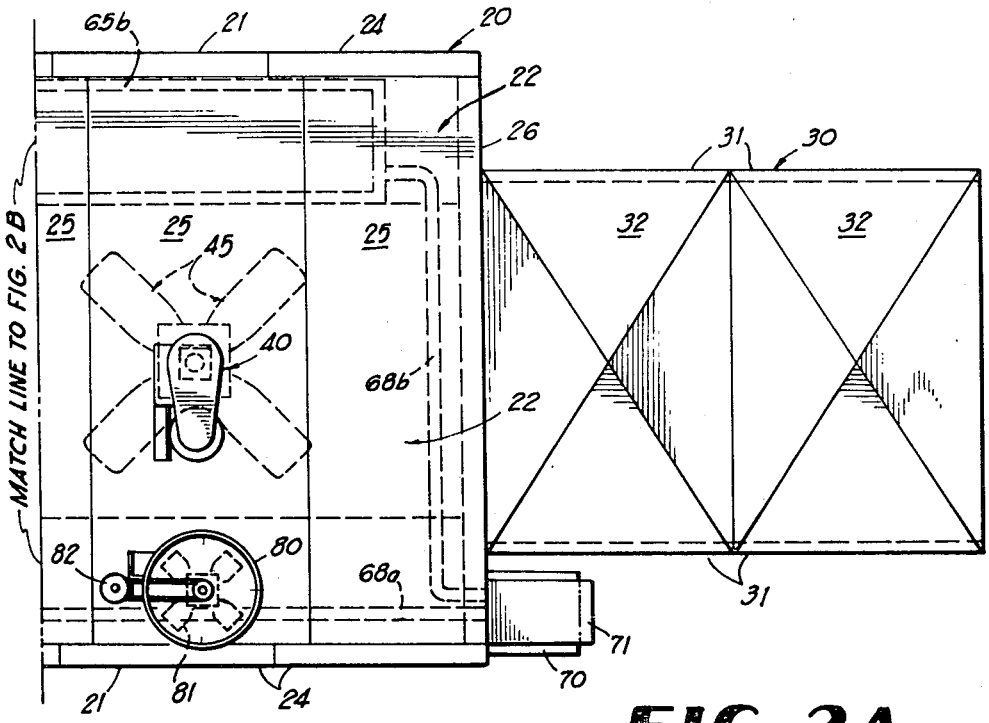
FIG. 2A is a top plan view of that portion of the oven shown in FIG. 1A.
Figure 2B:
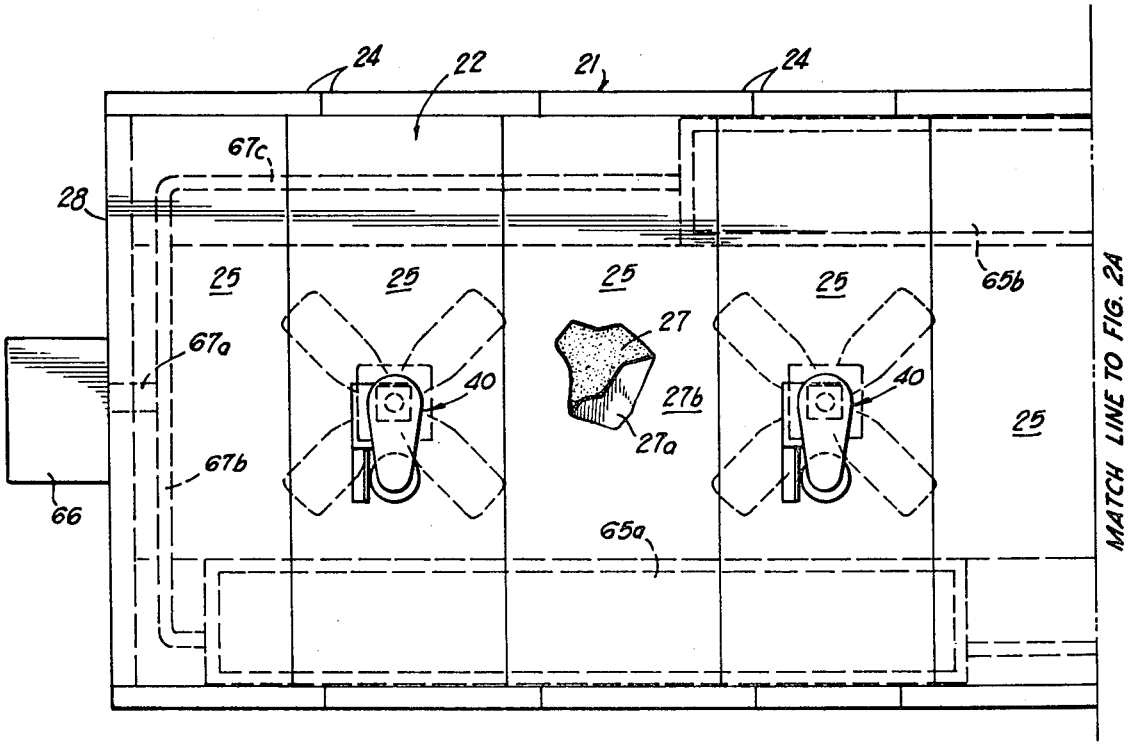
FIG. 2B is a top plan view of that portion of the oven shown in FIG. 1A.

In the present embodiment, three longitudinally spaced fan assemblies 40 are provided for housing 20, the shafts 43 thereof being disposed along a longitudinal center line of the roof or top 22, as seen in FIGS. 2A and 2B. The central fan assembly 40 is midway of housing 20 and the axes of the front and back fan assemblies 40 are equidistant from the axis of the central fan assembly 40, preferably being respectively about half the distance from the axis of the central assembly 40 to the front and back panel 26 or 28, as the case may be.

Figure 3:
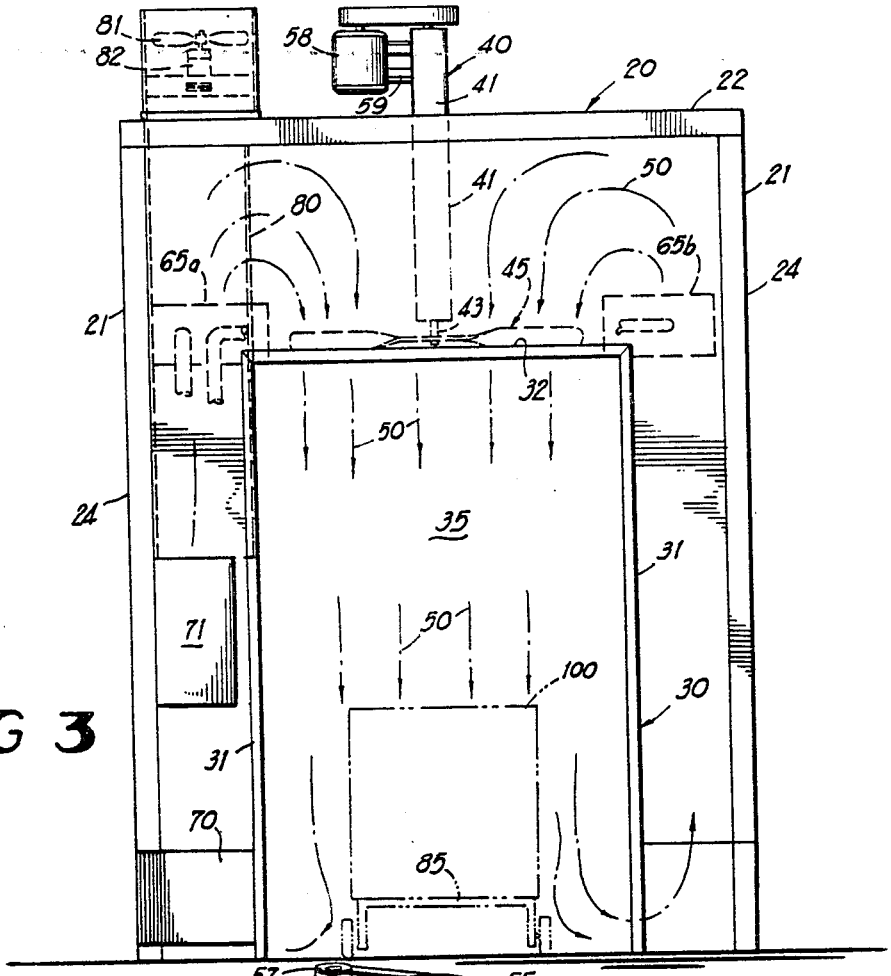
FIG. 3 is an end view of the front end of the oven shown in FIGS. 1A, 1B, 2A and 2B.

The shafts 43 of assemblies 40 are, thus, disposed vertically parallel to each other and are equally spaced longitudinally along the pathway of the objects 100. Each of the shafts 43 disposes its fan or propeller 45 in a common horizontal plane, parallel to roof wall 22, and generally coincides with the plane of the roof panels 32, as shown in FIG. 3. The diameter of each fan or propeller 45 is about one-fourth to about three-fourths the width of the housing 20 from said wall 21 to side wall 21. Preferably the diameter is about one-half such distance.

Within the housing 20 and outboard on opposite sides of the fans or propellers 45 of the three assemblies 40 are a pair of parallel, longitudinally extending, heat exchangers **65*a*, 65*b*. These heat exchanges 65*a* and 65*b*** are in staggered longitudinally overlapping relationship and each is a right prims or rectangular box-like member containing steam coils over which the air circulates.

As seen best in FIGS. 2A and 2B the heat exchanger **65*b* extends along the right side of the front fan 45 and middle or central fan 45. The heat exchanger 65*a* is disposed along the left side of the middle or central fan 45 and the rear fan 45. Thus, air circulated by the front fan 45 will pass essentially through only the heat exchanger 65*b*, the air circulated by the central fan 45 will circulate through both heat exchangers 65*a* and 65*b*, and the air circulated by the rear fan 45 will pass essentially through only the rear heat exchanger 65***a*.

Steam is supplied to both heat exchangers 65*a* and 65*b* from a supply connection and control valve 66, mounted on the outer surface of rear panel 28, via supply pipes 67*a*, 67*b* and 67*c*, to the rear ends of both heat exchangers 65*a*, 65*b*. Return water and steam from heat exchanger 65*a* is fed, via conduit 68*a*, to a steam trap and steam return member 70 on front panel 26. Return water and steam from heat exchanger 65*b* is fed, via conduit 68*b*, to member 70. A control box 71 above member 70 contains the thermostatic controls by which the temperature of the oven can be regulated.

For exhausting air, vapors and fumes from the interior of housing 20, a vertically disposed hollow, cylindrical, exhaust stack or duct 80 is provided in housing 20, as seen in FIGS. 1A and 2A. The stack protrudes through one roof panel 25 and projects down into the interior to terminate at mouth 83 in an area well below the level of fans 45, as shown in FIG. 1A. The stack 80 is laterally offset from the first fan assembly 40 so as to be about midway or in the forward intermediate portion along the passageway formed by the vestibule 30 and housing 20. An exhaust fan 81 is disposed with its motor 82 in the upper end portion of duct 80. The lower end or mouth 83 is open and provides an intake port through which all air is drawn from the interior into the duct 80. For protection, a screen or grid 36 is disposed horizontally in the oven below blades 45.

In operation the oven of FIGS. 1A, 1B, 2A, 2B, 3 and 4 is brought up to temperature and the motors 58 are energized to operate the fans 45. The objects 100 to be dried are then passed successively on conveyor 85 through the passageway 35 in the direction of the arrows in FIG. 1A and FIG. 1B.

The fans 45 each direct the air in circular paths as shown in FIG. 3, down onto the object 100 and then up through the heat exchanger 65*a* and 65*b* which is adjacent to the particular fan 45. Thus, heated high velocity air is directed onto the object 100 so that it is dried quite quickly. Since the drying is proportional to the temperature of the air and its velocity over the object, the high volume of air, thus delivered, drys the object in a fraction of the time previously taken. The impelling of the air against the object to be dried reduces to a minimum the boundary layer of the surface coating.

Figure 5:
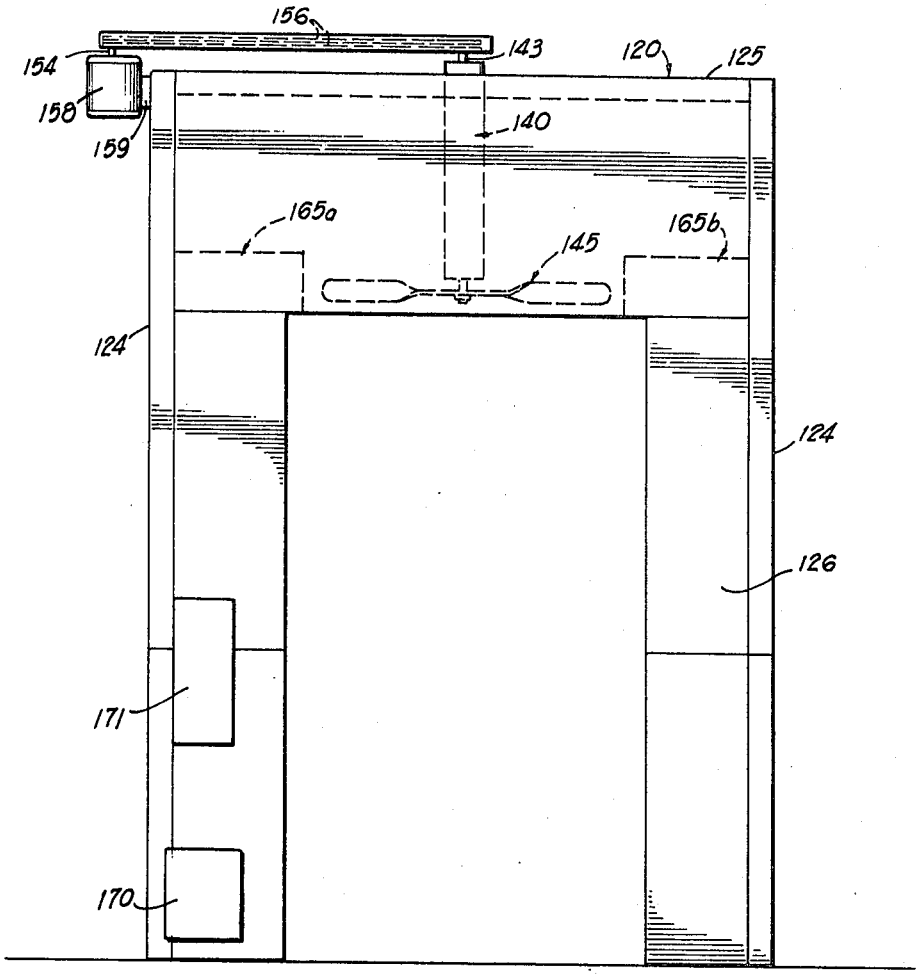
FIG. 5 is an end elevational view of another form of the oven of the present invention.
Figure 6:
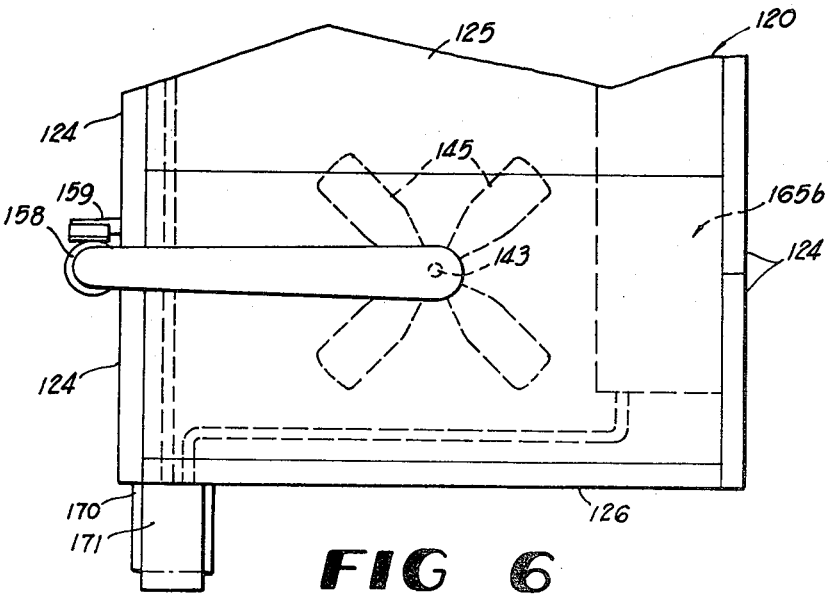
FIG. 6 is a fragmentary top plan view of the oven shown in FIG. 5.

In the embodiments of FIGS. 5 and 6, it is seen that if there is a problem with low ceilings in a plant, the motor 158 can be mounted by brackets 159 to a side panel 124, adjacent its upper edge, so that the shaft 154 of the motor 159 protrudes about the surface of roof panel 125. Thus, the drive belt 156, which drives the fan shaft 143, extends over the roof panel 125 of the housing 120, closely adjacent and parallel to panel 125. The fan assemblies 40 are identical to fan assemblies 40 and the shaft 143 thus drives the fan 145.

The remaining structure of FIGS. 5 and 6 are otherwise identical to FIGS. 1A, 1B, 2A, 2B, 3 and 4, however, the vestibule 30 is eliminated. In this embodiment, the heaters 165*a* and 165*b* are identical to heaters 65*a* and 65*b* and feed to a steam trap member 170 which is similar to trap member 70. The control box 171 on front panel 126 corresponds to control box 71.

Figure 7:
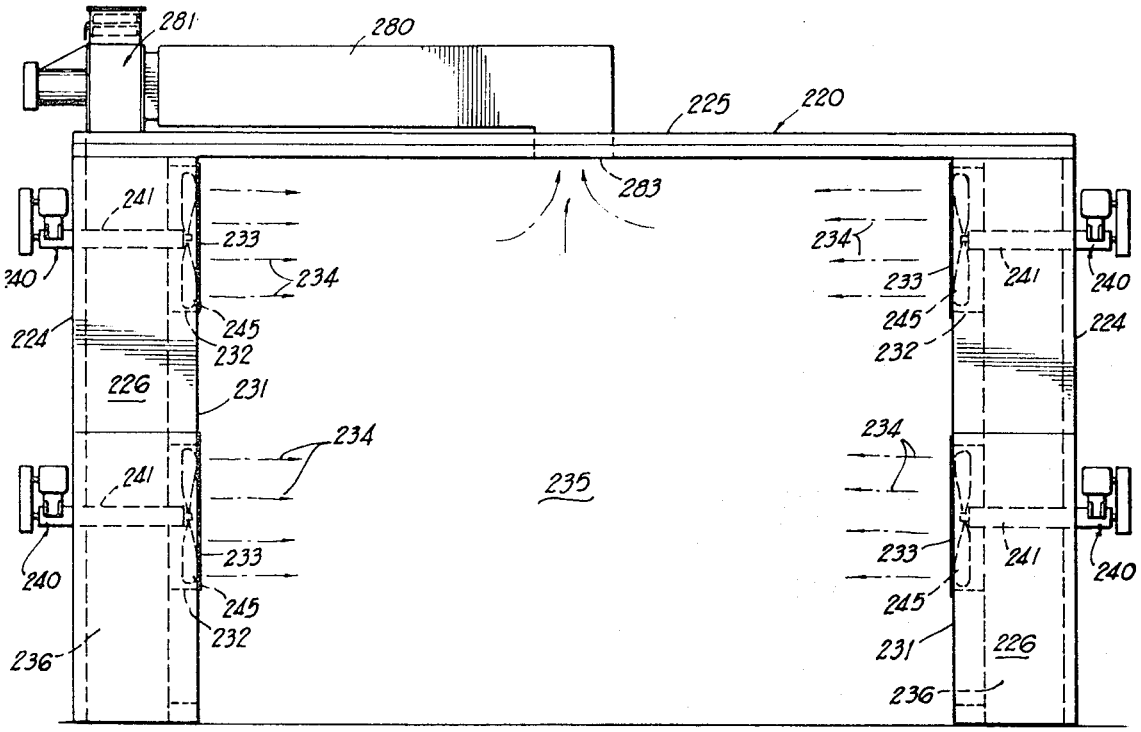
FIG. 7 is an end elevational view of still another form of oven of the present invention.
Figure 8:
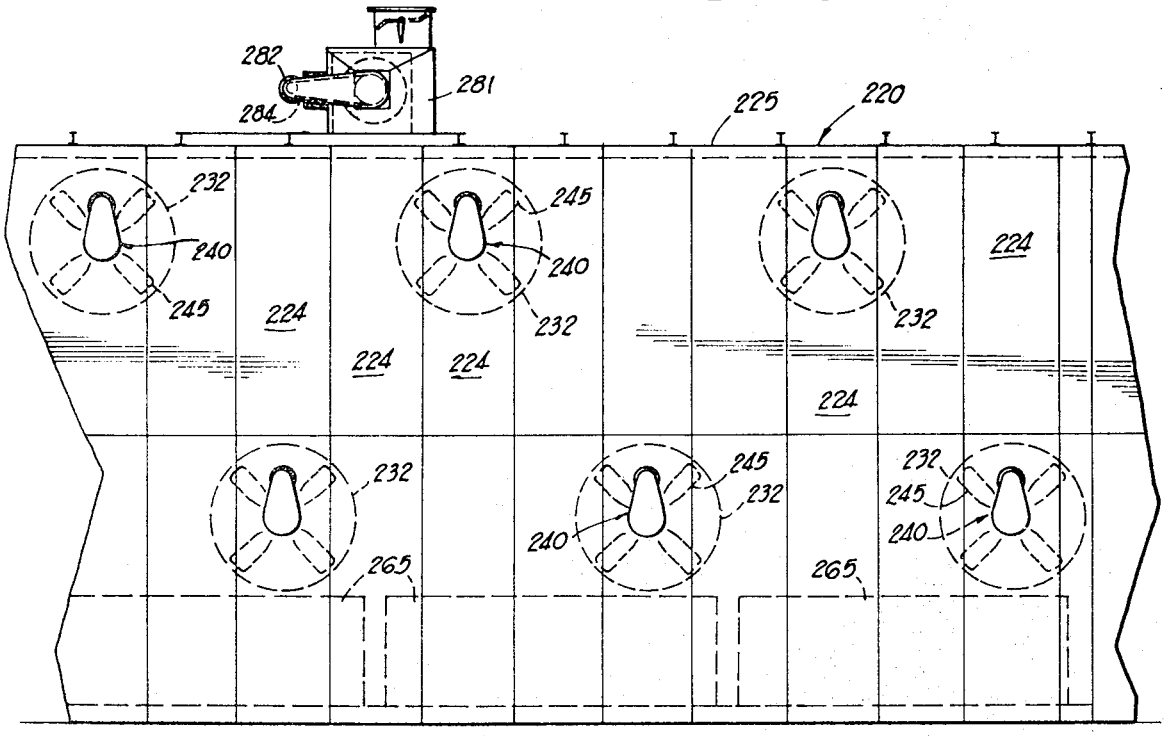
FIG. 8 is a fragmentary side elevational view of the oven shown in FIG. 7.
Figure 9:
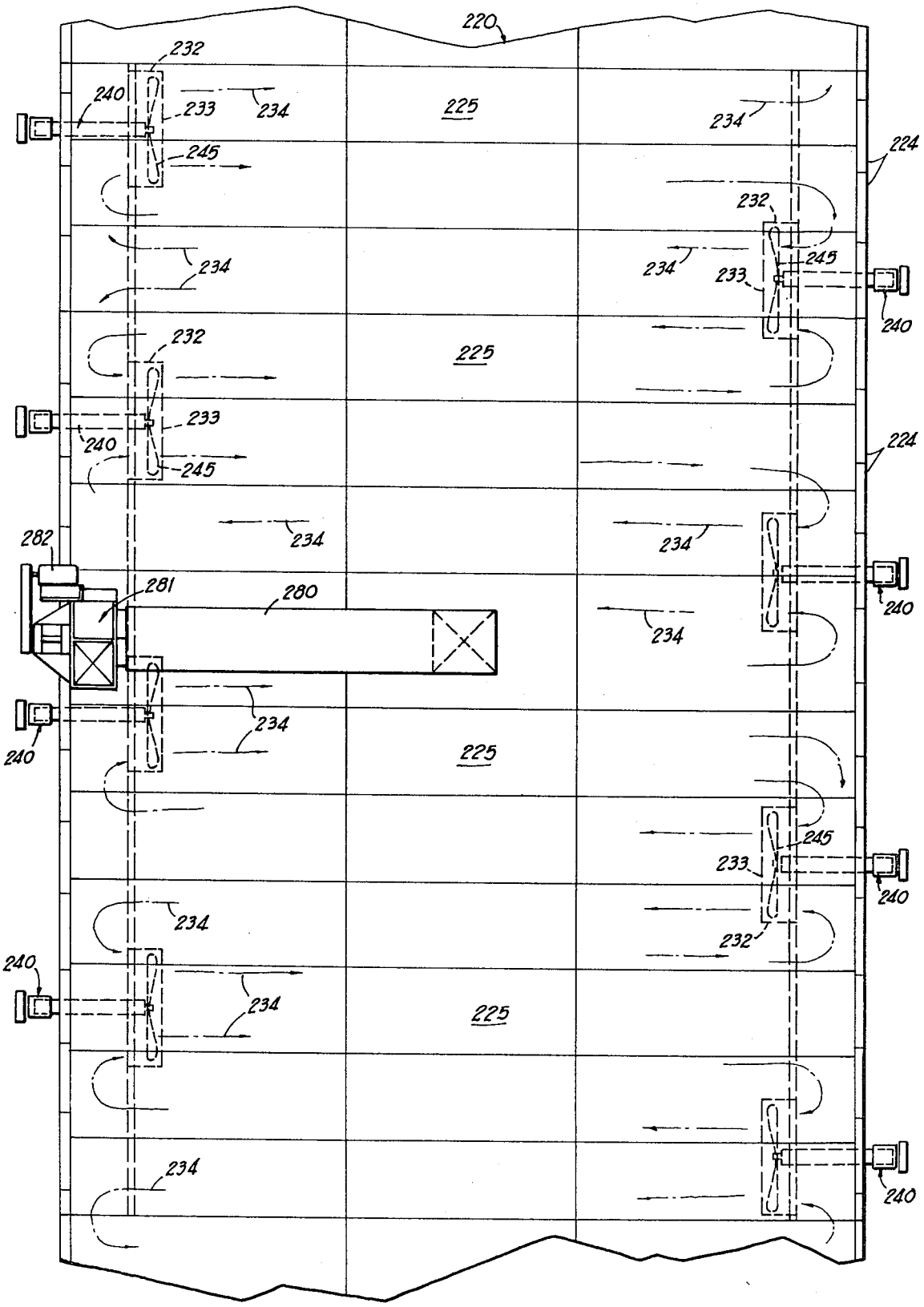
FIG. 9 is a top plan view of the oven shown in FIGS. 7 and 8.

In the embodiment of FIGS. 7, 8 and 9, the oven is illustrated as having an inverted channel shaped housing 220 formed of side panels 224 and roof panels 225. The housing 220 also has front panels 226 defining an entrance opening of an open passageway 235 through the housing 220.

A plurality of fan assemblies 240, identical to assemblies 40, are disposed in and supported by the side panels 224 so that the fans 245 thereof, which are spaced inwardly of the inner surfaces of panels 224, direct the air, horizontally, inwardly from both sides, as shown by the arrows 234 of FIGS. 7 and 9.

In the present embodiment, there are opposed vertical inner walls 231 from the floor to the roof of housing 220, inwardly parallel to the side panels or vertical walls 224. End panels such as front panels 226 joins the ends of walls 224 and 231 on both sides of housing 220, to define plenums 236.

The inner end of casing 241 of each fan assembly 240 protrudes into a circular opening in its associated inner wall 231 so that an annular shroud or cowling 232, carried by the wall 231, defines the opening surrounding the fan 245. A grid or mesh cover 233 extends over each cowling 232.

The fan assemblies 240 in each side of housing 220 are disposed in parallel horizontal rows as shown in FIG. 8. The fan assemblies 240 in each row are equally spaced from each other and are staggered with respect to the fan assemblies 240 of the adjacent horizontal row.

Furthermore, the fan assemblies 240 on one side of housing 240 are staggered with respect to the fan assemblies 240 on the other side thereof as shown in FIG. 9.

Carried in walls 231, below the fans 245 and their cowlings 232, are a plurality of steam heat exchangers 265. Each of the heat exchangers 265 have a steam coil over which the air, entering the plenums 236 from the interior of housing 220, passes. The heat exchangers 265 are arranged in both walls 231 in rows, below the fans 245, as shown in FIG. 8.

As seen best in FIG. 7 in the central portion of the roof of housing 220 is the intake end 283 of an exhaust duct 280 which extends up a short distance and then horizontally transversely across the roof of housing 220 to terminate at and communicate with the intake of a centrifugal blower 281 mounted on the roof adjacent on side wall 224 and driven by an electric motor 282 through belt 284. The blower 281 discharges, upwardly.

In operation of the oven of FIGS. 7, 8 and 9, the motors 258 of the fan assemblies 240 are energized to rotate the fans 245 thereof and produce horizontally inwardly directed currents of air in alternate counter flow relationship, as shown by arrows 234 in FIGS. 7 and 9. The fans 245 draw a partial vacuum in the plenum chambers 236 so as to draw air into the chambers 236 through the coils of the heat exchangers 265. Thus, high velocity air is directed onto objects (not shown) which are passed successively through the interior of the housing 220 and between the opposed banks of fans 245.

Figure 10:
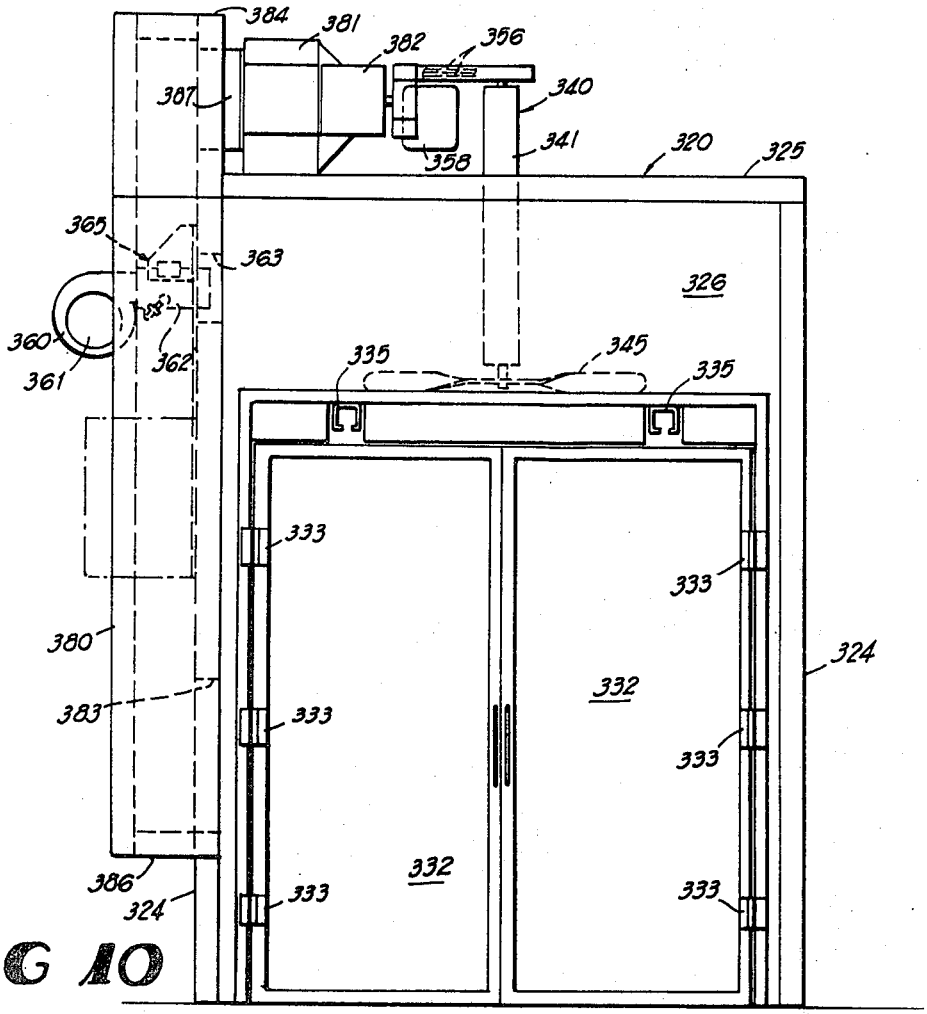
FIG. 10 is an end elevational view of another form of oven of the present invention.
Figure 11:
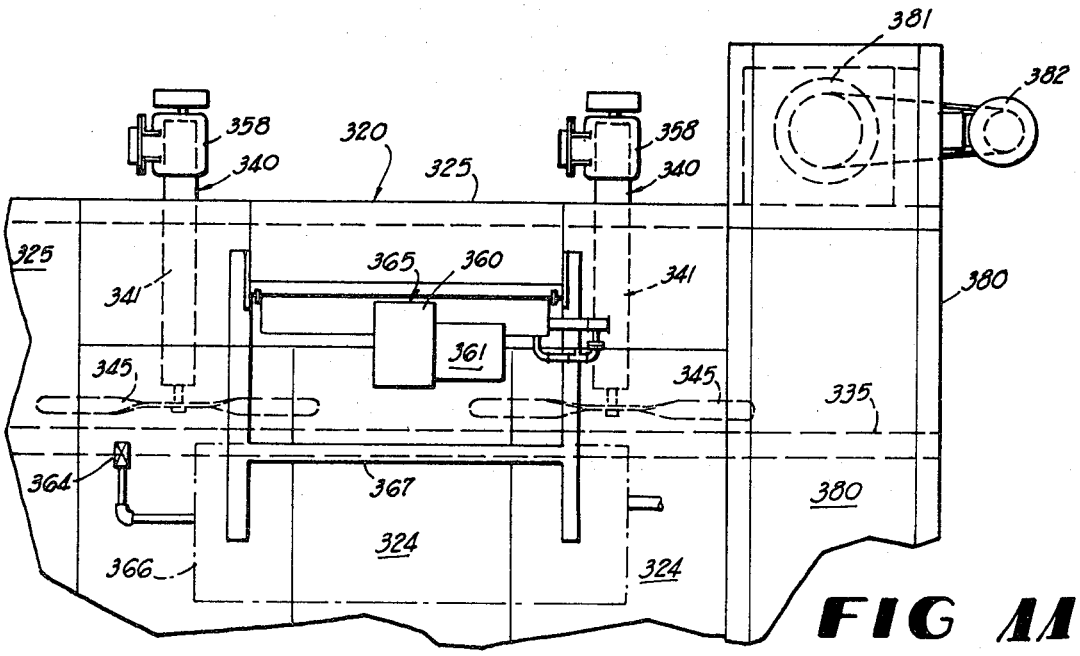
FIG. 11 is a fragmentary side elevational view of the oven shown in FIG. 10.

In the embodiment of FIGS. 10 and 11, a closed gas fired oven is disclosed. This oven includes an inverted U-shaped housing 320 with side walls 324 and a roof 325 formed of abutting insulated panels and resting on the floor. Two spaced, longitudinally centered, fans 345 carried by fan assemblies 340 direct air in a downward direction in the interior of the oven. Each fan assembly 340 is identical in construction to the fan assembly 40 and has an external motor 358 carried by bracket 359, driving a belt 356 to rotate the vertically disposed shaft 343 in casing 341 to rotate fan 345.

In the housing 320, the front and back are identical, each as the case may be. Door jam 331 in the wall 326 respectively support hinged opposed doors 332, by hinges 333, so that the entrance or exit opening may be closed or opened by manual manipulation of the doors 332.

Above the doors 332, a pair of spaced straight tracks 335 extend in parallel relationship, parallel to the walls 324 through the interior of the oven. The tracks 335 pass generally tangentially adjacent to and below the path of travel of the tips of fans 345. Objects (not shown) to be dried are suspended from the tracks 335 and passed into the oven and then out of the oven.

Adjacent to one side wall 324 is a vertical exhaust stack 380 which has a mouth or exhaust opening 383 at one side adjacent its bottom. The opening 383 communicates with the interior of the housing 320 at a level well below fans 345. The stack 380 protrudes above the roof 325 and is closed at both ends by end plates 384 and 386. A sidewise extending duct 387, at the upper end portion of stack 380 communicates with the intake of a centrifugal exhaust blower 381 driven by motor 382. The blower 381 is mounted on the roof 325 and discharges upwardly.

A substantial portion of the air introduced into the oven or housing 320 is through an air blower 360 of a heater or burner assembly 365. The blower 360 is driven by a motor 361 and discharges air into a gas burner 362 which directs a mixture of air and gas as a flame sidewise through an opening 363 in side wall 324. The burner assembly 365 is carried on the upper central portion of a side wall 324, as shown in FIGS. 10 and 11, so as to direct the flame into the interior of the housing 320 above the plane of rotation of the fans 345 and midway between the fan assemblies 340. Thus, the fans 345 will direct the heated air downwardly onto the objects to be dried in the oven. Gas for the burner 362 is supplied via a gas valve 364 through gas manifold 366 and pipes 367.

Figure 13:
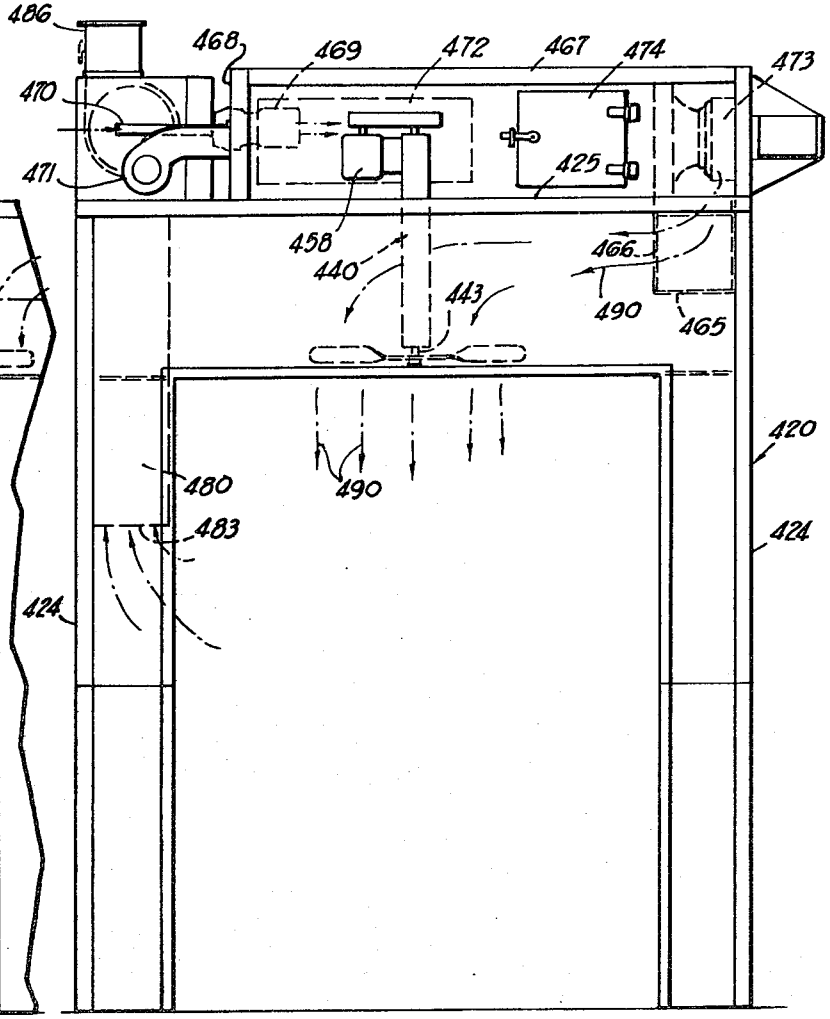
FIG. 13 is an end view of one end of the oven shown in FIG. 12.
Figure 12:
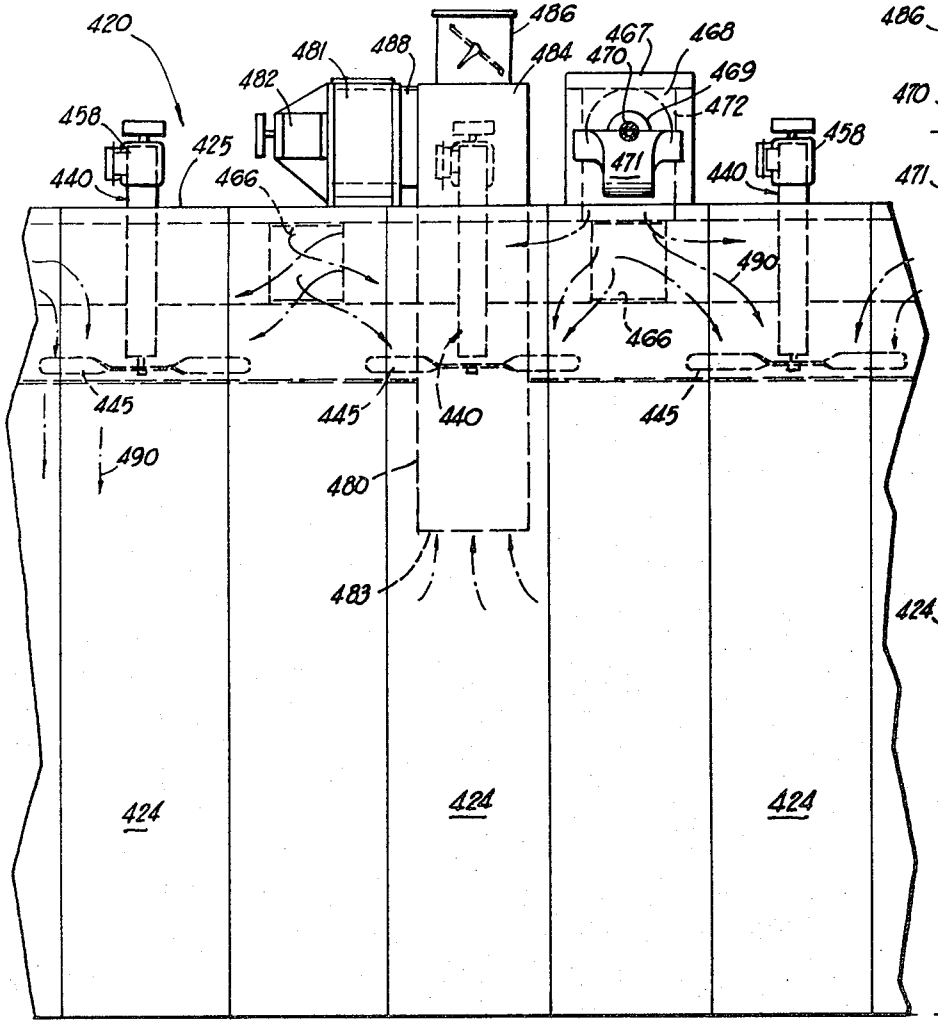
FIG. 12 is a fragmentary side elevational view of still another oven of the present invention.

In the embodiment of FIGS. 12 and 13 a gas fired oven is disclosed. This oven has the inverted U-shaped housing 420, provided with opposed vertical said walls 424, the upper edges of which are joined by a flat roof 425. The oven has at its ends, smaller entrance and exit vestibules, similar to the entrance vestibule 430 which is connected to the end walls 426 of the housing 420. The vestibule 430 is a tunnel like member, identical in construction to vestibule 30 of FIGS. 1A and 2A. Thus, more detailed disclosure is not deemed necessary. Suffice it to state that successive objects (not shown) to be 430, then pass through the interior of housing 420 and, thence, through the rear vestibule (not shown) to the exterior.

Carried by the roof 425 and disposed at equally spaced intervals along the longitudinal centerline of the housing 420 are the fan assemblies 440 which are each identical to the fan assembly 40. Thus each has a vertical shaft 443 rotated by an external motor 458 to drive a fan 445 for rotation about the vertical axis of the shaft 443. Thus, a high velocity downdraft in housing 420 is generated.

Disposed longitudinally along the interior common edge between the roof 425 and one wall 424 is a rectangular air distribution duct 465. This duct 465 extends throughout the length of the interior of the housing 420, from one end wall 426 to the other. Approximately midway between adjacent fan assemblies 440, are sidewise opening discharge ports 466 in the duct 465.

In the central portion and extending transversely across the roof 425 is a rectangular heater duct 467. One end portion of duct 467 opens downwardly and communicates, through roof 425, with a central port in the air distribution duct 465. The other end portion of duct 467 terminates in an end plate 468 through which a gas burner 469 projects. A pipe 470 supplies gas to burners 469 and an air blower 471 supplies air for producing a combustible mixture which is discharged into a hollow tubular open ended flame tube 472 within the interior of duct 467.

The other end of duct 467 is closed by a supply fan 473. The function of supply fan 473 is to accelerate the products of combustion received by duct 467 as they pass from duct 467 to duct 465 so that they are distributed to the longitudinally spaced discharge ports 466. An access door 474 is provided in the side of duct 467.

For exhausting air from the interior of housing 420, a vertically disposed exhaust duct 480 is provided. This duct 480 protrudes through the roof 425 and downwardly, adjacent the side wall 424 which is opposite to duct 465. The open lower end or mouth 483 of duct 480 terminates well below the horizontal plane of fans 445. The upper end of exhaust duct 480 has an end plate 484 which receives a smaller cylindrical duct 486 provided with a transversely pivotally mounted flapper valve 485 which functions as a damper.

An exhaust blower 481 driven by a motor 482 has its suction side connected via conduit 488 to the upper side of the end portion of duct 480. The blower 481 exhausts upwardly. The setting of damper 485 determines the amount of air withdrawn via duct 480 from the interior of housing 420.

In FIGS. 12 and 13 the air is circulated as indicated by arrows 490 for drying the objects (not shown) disposed in the interior of the housing 420.

Figure 14:
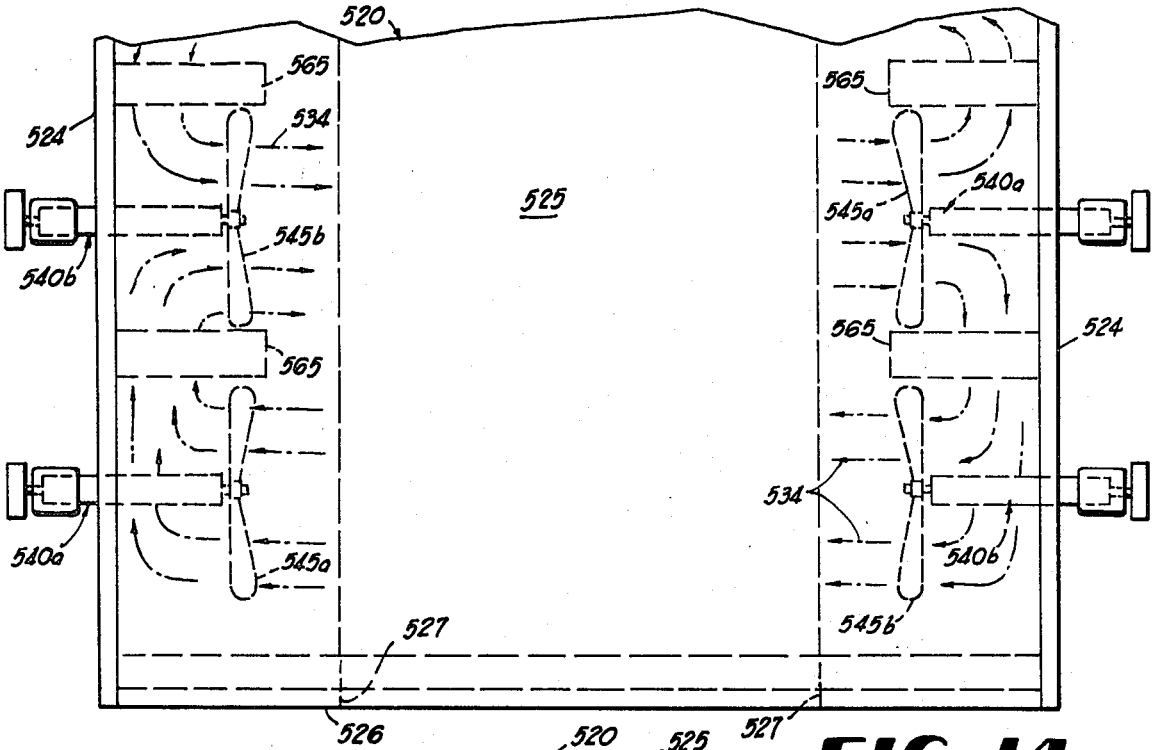
FIG. 14 is a plan view of another form of oven constructed in accordance with the present invention.
Figure 15:
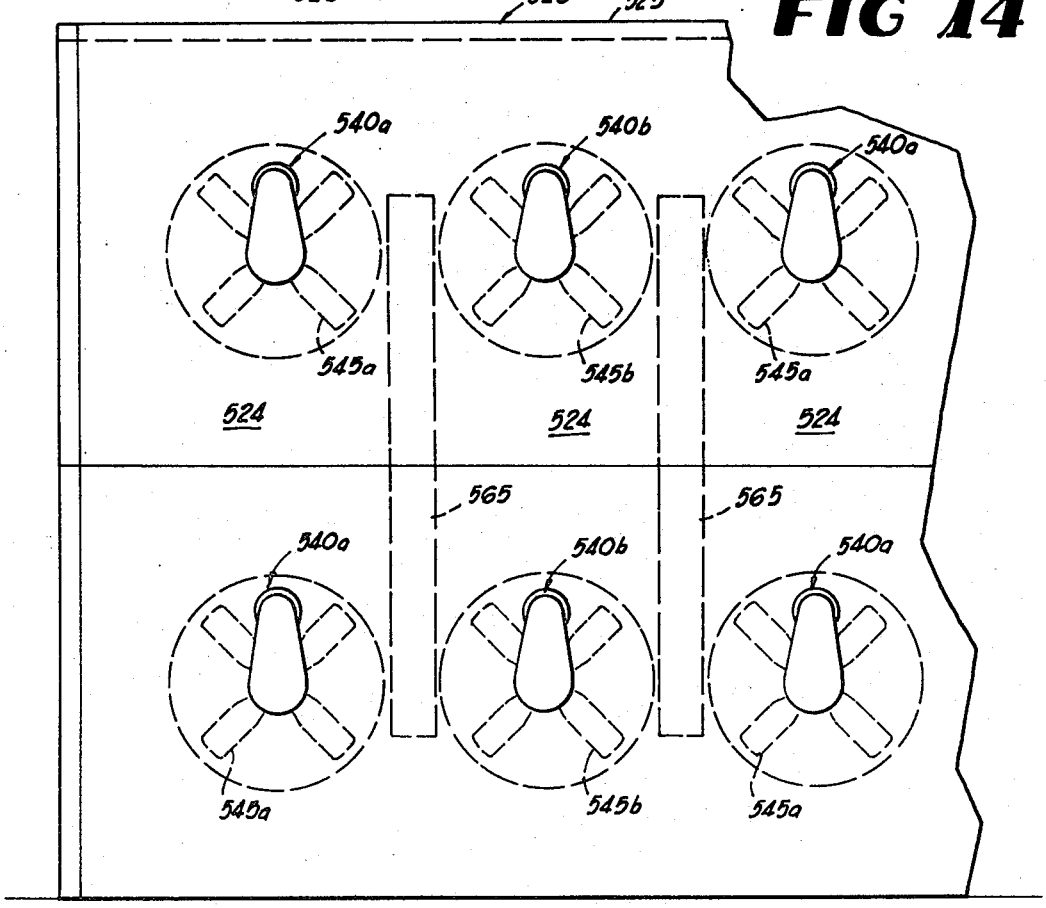
FIG. 15 is a side elevational view of the oven shown in FIG. 14.

The next embodiment is depicted in FIGS. 14 and 15, wherein an inverted U-shaped housing 520 is provided, the housing 520 having side walls 524 and a roof 525. Objects are to be dried enter the housing 520 through an appropriate opening 527 in the front 526 of the housing 520. They then travel longitudinally through the housing 520. Disposed on opposite sides of the path of travel of the object through the housing 520 are a plurality of eqally spaced fan assemblies **540*a* and 540*b* which are substantially identical in construction to the fan assembly 40, except that the fan assembly 540*a* rotates the fan 545*a* so as to draw air into it and the fan assembly 540*b* rotates its blade 545*b* in a direction to thrust air away from the fan assembly 540*b*, as illustrated by arrows 534 in FIG. 14**.

Each fan assembly **540*a* which is disposed in one side 524, has an opposing fan assembly 540*b* transversely opposite to it and supported by the other side wall 524**.

Preferably, the fan assemblies are arranged in rows as shown in FIG. 15, one row being disposed above the other. In such a row, the fan assemblies **540*a* and 540*b* are arranged alternately. Also, the fan assemblies 540*a* are arranged vertically one above the other and the fan assemblies 540*b* are likewise arranged one above the other on a single side. Disposed between adjacent fan assemblies 540*a* and 540*b* are heat exchangers 565 which are supplied with steam and have steam coils in substantially the same manner as described for the heat exchanges 65*a* and 65*b*. These heat exchangers 565 are mounted vertically to the inside surfaces of walls 524 and extend forwardly so as to terminate in a position forwardly of the plane of the blades of fans 545*a* and 545*b* of their associated fan assemblies 540*a* and 540*b*. Thus, the air drawn in by these fans 545*a* is directed through the heat exchangers 565 which are disposed on one or both sides of the fan 545***a* and this air is delivered then to the fans 545*b* so as to be discharged into the interior of the housing 520 and against the object to be dried.

Figures 16A, 16B:
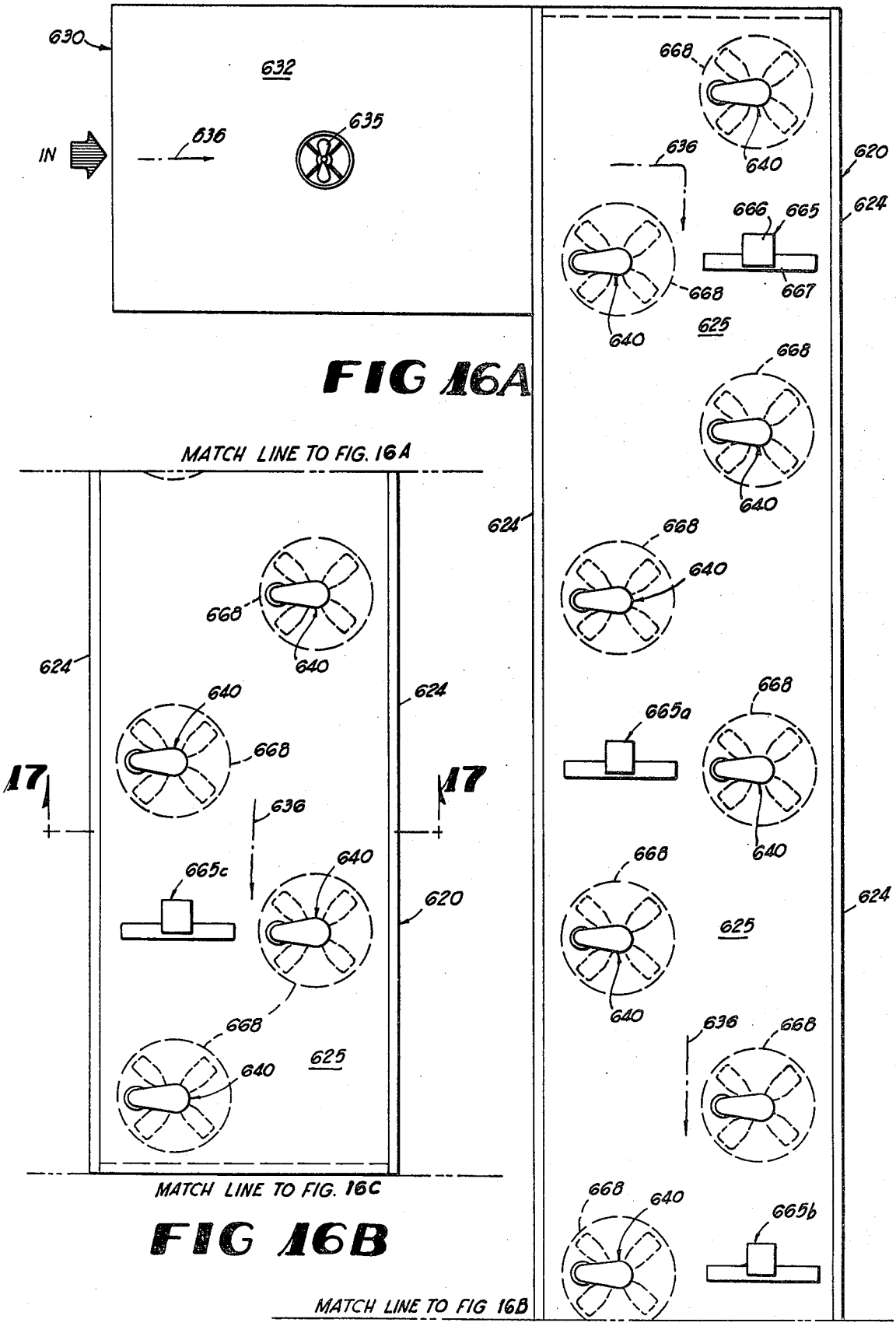
FIG. 16A is a top plan view of a portion of another form of oven, constructed in accordance with the present invention.
FIG. 16B is a top plan view which is a continuation of the view shown in FIG. 16A.
Figure 16C:
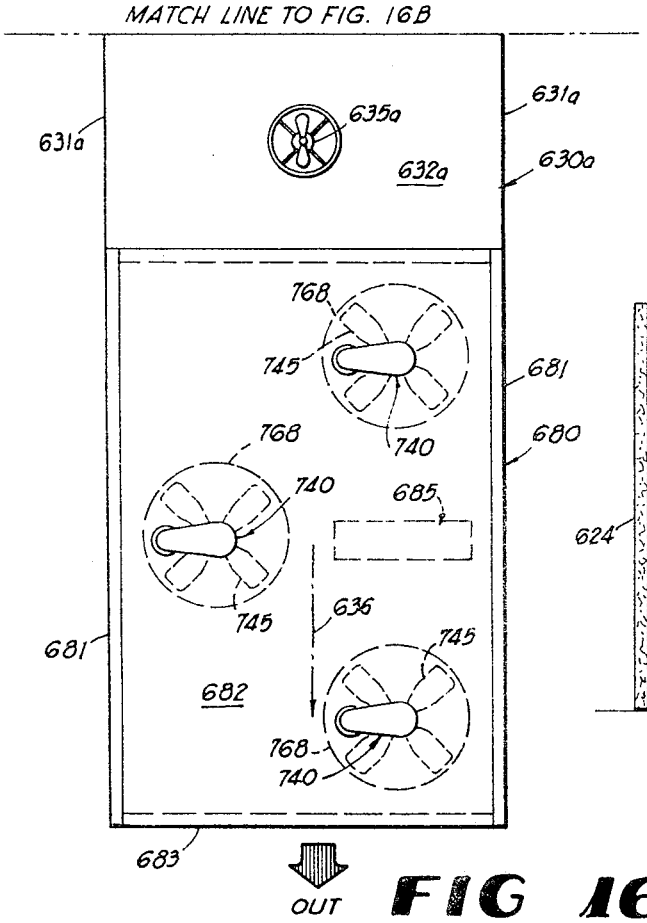
FIG. 16C is a top plan view which is a continuation of the view shown in FIG. 16B.
Figure 17:
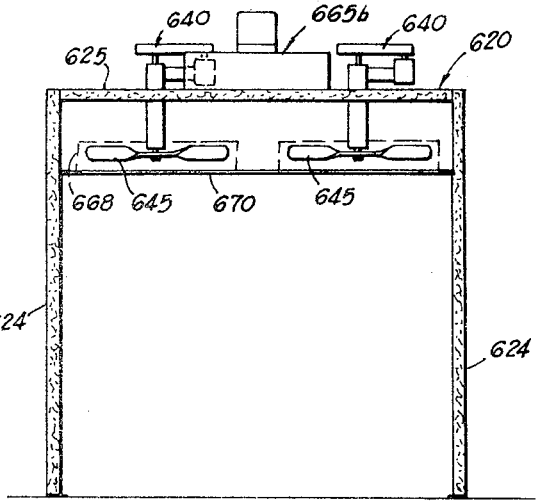
FIG. 17 is a vertical sectional view taken substantially along line 17—17 in FIG. 16B.

The next embodiment of the present invention is depicted in FIGS. 16*a*, 16*b*, 16*c*, and 17. In this embodiment, the object to be dried is subsequently cooled so that it can be handled as soon as it emerges from the drier. Referring specifically to FIG. 16*a*, it is seen that the housing 620 is formed of a pair of vertically disposed parallel opposed side walls 624 joined along their upper edge by a roof 625 as shown in FIG. 17. Thus, like the preceeding embodiments the housing 620 is an inverted U-shaped member. Its front end, however, is closed by an end wall 627 and one side thereof, adjacent to the end wall 627 is open to communicate with a vestibule, denoted generally by numeral 630. The vestibule 630 is substantially identical in construction to the vestibule 30 and hence no detailed description is required except to state that there is an exhaust fan, denoted generally by numeral 635 disposed in the roof 632 of the vestibule 630. The vestibule 630 is open at the front and receives successive objects (not shown) which are moved by a conveyor (not shown) along a path of travel, denoted by the broken line 636.

Upon passing through the vestibule 630, the objects are fed successively sidewise into the front end of the housing 620 and, thence, longitudinally along the path of travel denoted by the broken line 636 as shown in FIG. 16*a*. Along this path of travel are a plurality of fan assemblies, denoted by the numeral 640. Each fan assembly is carried by the roof 625 so that its fan 645 is rotated about a vertical axis and is spaced below the inner surface of the roof 625. Since the fan assembly 640 is identical to the fan assembly 40, no more detailed description is provided of the same except to state that the fan assemblies 640 are arranged in two parallel longitudinally extending rows parallel to the side walls 624 and are respectively staggered so that the fan assembly 640 in one row is adjacent one wall 624 and the next fan assembly 640 is adjacent the other wall 624.

Between the first two fan assemblies 640 in one row, as seen in FIG. 16*a*, heater assembly, denoted generally by the numeral 665, is provided in the roof 625. This heater assembly 665 is a direct fired burner and includes a combustion air blower 666 and a burner body 667 which receives the air and gas to produce a combustible mixture and directs the products of combustion downwardly through the roof 625 so that the flame burns within the interior of the housing 620. Additional heaters 665*a*, 665*b*, and 665*c* are disposed in staggered relationship in the roof 625, as shown in FIGS. 16*a* and 16*b*. The burner assembly 665*a* is disposed between the second and third fan assembly 640 on the right side and the burner assembly 665*b* is disposed between the 4th and 5th fan assembly 640 on the left side. The burner assembly 665*c* is disposed between the last two fan assemblies 640 on the right side of the oven. Each provides a combustible mixture of gas and fuel in a downwardly directed flame.

It will be observed in FIG. 17 that all fans 645 of the fan assembly 640 are disposed in a common horizontal plane spaced below the lower surface of the roof 625. A protective screen 670 is disposed in spaced relationship parallel to and below the plane of fans 645, the screen 670 being supported by the side walls 624, as illustrated in FIG. 17. Cowlings 668 supported by the screen 670 respectively surround the fans 645.

Connected in tandem to the discharge or rear end of the housing 620 is a second vestibule, denoted by the numeral 630*a* in FIG. 16*c*. This vestibule 630*a* has a roof 632*a* supported by side walls 631*a*. It also has an exhaust fan 635*a* in the central portion of the roof 632*a*. The walls 631*a* are extensions of the walls 624 while the roof 632*a* is in a common horizontal plane with the roof 632 and is at approximately the same height as the protective screen 670.

Any excess air, fumes, vapor and gases which accumulate in the housing 620 are withdrawn by the exhaust fans 635 and 635*a*.

Connected in tandem to the discharge or rear end of the vestibule 630*a* is a cooling chamber, denoted generally by the numeral 680. This cooling chamber 680 has side walls 681 and a roof 682. It too is an inverted U-shaped member which corresponds to the cross sectional dimensions of the housing 620. It too is provided with staggered cooling fan assemblies 740 mounted through the roof 682. Each fan assembly 740 is identical to the fan assembly 40 and has a fan 745 disposed in a common horizontal plane which coincides with the common horizontal plane of the fans 645. It too has a protective screen (not shown) and cowlings 768 for the fans 745. Since there is no heating element associated with the fans 740, they function to quite rapidly cool the surfaces of the objects which pass there beneath. Hence, the objects are successively discharged from the rear end 683 of the cooling chamber 680. It will be understood by those skilled in the art, that if desired, cooling coils in a heat exchanger, such as heat exchanger 685, may be incorporated in the roof 682 of the chamber 680, if desired. Thus, additional cooling of the objects may be readily provided.

Figure 18:
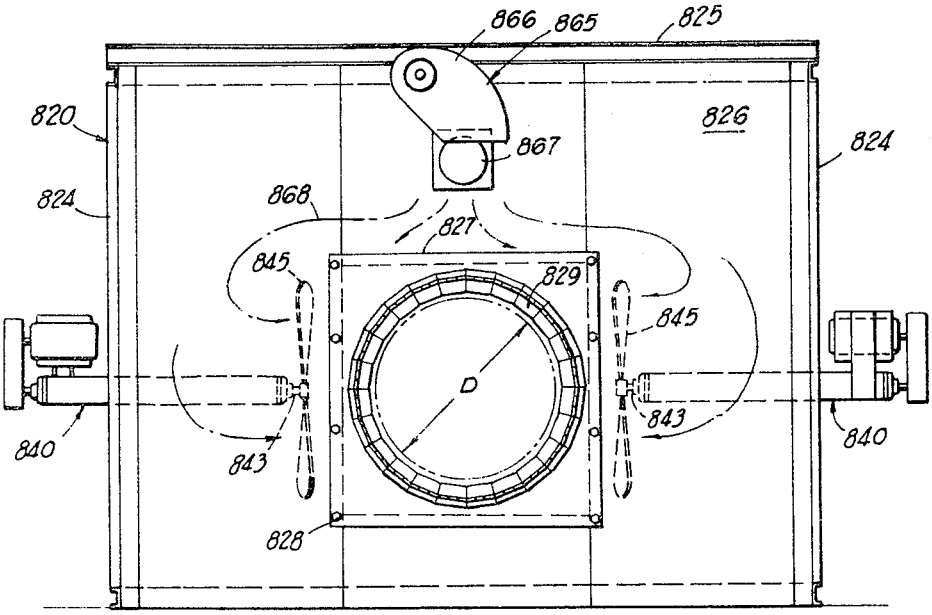
FIG. 18 is an end elevational view of still another form of oven constructed in accordance with the present invention.

In the embodiments shown in FIG. 18 of the present invention, still another form of the present invention is depicted. This oven is for drying freshly painted pipes or other cylindrical members as they are passed fromone end to the other through the housing, denoted generally by the numeral 820. In more detail, the housing 820 has side walls 824 and a roof 825 and is closed at both ends by end walls which are substantially identical. Thus, only one end wall 826 is illustrated.

Within the central portion of the end wall 826 is a square or rectangular central opening, over which extends a sheet metal plate 827, being secured to the end wall 826 by means of screws 828. A plurality of juxtaposed circumferentially disposed flexible closure plates 829 are secured to the plate 827 so as to protrude into the opening defined by the circular inner edge of the plate 827. The purpose of the flexible closure plates are simply to reduce the effective diameter of the opening in the plate 827 so that there is very little space between the surface of a cylindrical object such as a piece of pipe which has a Diameter D and is fed from one end of the housing 820 through to the other end of the housing 820, being supported externally at an appropriate height.

Within the housing 820 are a pair of opposed fans 845 which are disposed on opposite sides of the path of travel of the object. These fans 845 are rotated about aligned horizontal axes of their shafts 843. The fans 845 and shafts 843 form elements of the fan assemblies 840 which are identical to the fan assemblies 40 and are supported, as illustrated in FIG. 18, by the side walls 824. A heater, denoted generally by the numeral 865, includes a blower 866 and a burner 867. The burner 867 is mounted in one of the end walls 826, as illustrated in FIG. 18, and directs the mixture of either gas or oil and air into the interior of the housing 820 in essentially a horizontal path blow the roof 825 and above the path of travel of the object. Thus, the fans 845 draw the heated products of combustion in pairs as illustrated by the arrows 868 in FIG. 18 and direct this heated gas against opposite sides of the object, simultaneously.

In the embodiments hereinbefore described, it is important that the fans 45, 145, 245, 345, 445, 545, 645, 745 and 845 be spaced from their associated wall or roof by at least about two feet and not more than about six feet. By so positioning the fans, there is very little vacuum drawn on the back sides of the fans in delivering a very high velocity of air. The heaters which are disposed in various relationships to the fans are all arranged so that the air is heated immediately prior to being delivered to the back sides of the fans. Furthermore, the return velocity of the air where it, at times, is again heated by the heating elements, is quite low, thereby enabling substantial heat transfer before the air is again delivered by the fans at high velocity. Since the velocity of the air is low, on return, there is little trash picked up from the floor. The heat can be fed into the oven at substantially any place and will be quite readily disseminated throughout the oven. Therefore, the oven is quite uniformly heated. Heat introduced, however, should be generally transverse to the path of travel of the propeller or fan blades.

In the fan assembly 40, the inner bearing, which permits both rotational movement and axial movement, is cooled by the flow of air in the casing 41 and the shaft is, likewise, cooled. The air is introduced from the exterior down past the shaft and past the inner bearing, due to the low pressure or slight vacuum generated on the back side of the fans.

Since the air is delivered quite rapidly and at high velocity of the surfaces to be dried, there is little need for heating the oven beyond about 900° F. to aachieve very rapid drying of the surfaces of the objects. Thus, aluminized steel plates may be utilized for the panels from which the housings are made. In the event that temperatures from about 900° F. to about 1800° F. are contemplated for the iinterior of the oven, it is recommended that stainless steel be used for the panels and that Inconel blades be employed for the fans.

Figure 19:
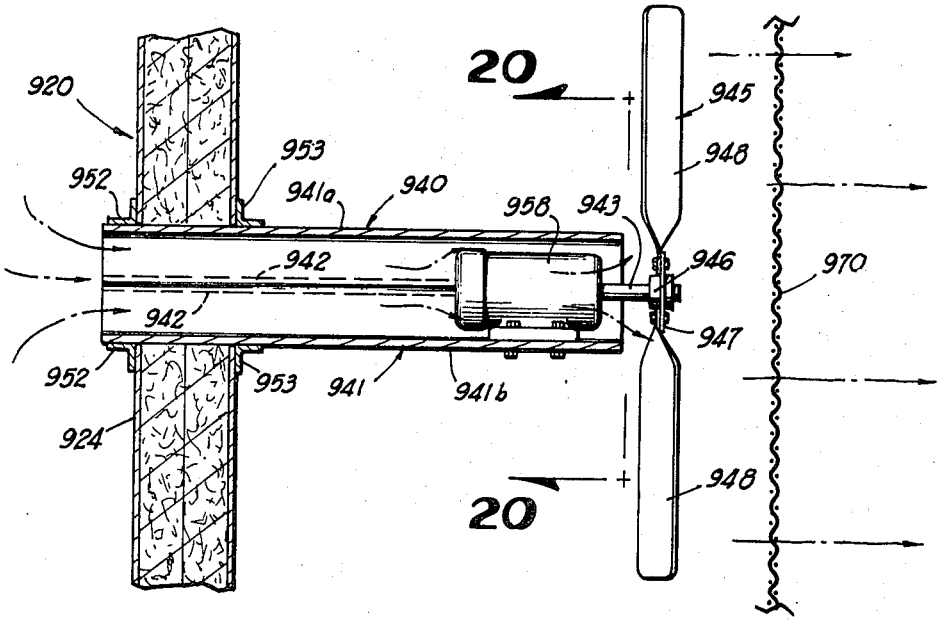
FIG. 19 is a vertical sectional view of a modified form of fan assembly which can be substituted for the fan assemblies of the preceeding embodiment.
Figure 20:
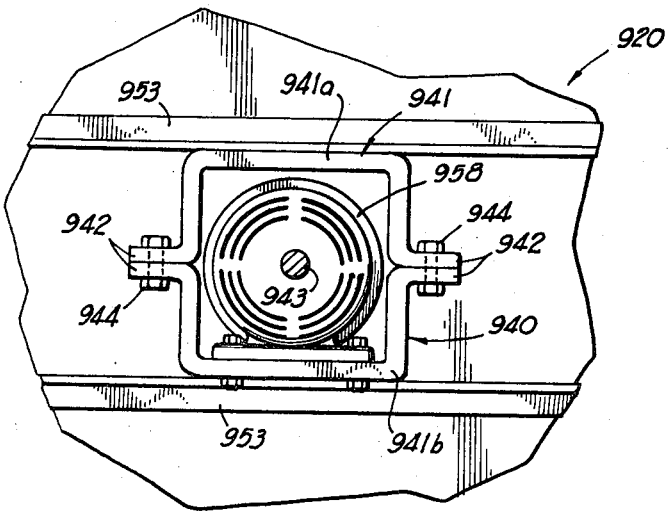
FIG. 20 is a cross-sectional view taken substantially along line 20—20 in FIG. 19.

As seen in FIGS. 19 and 20, a modified form of fan assembly 940 which is particularly suited to low temperature ovens, i.e. ovens which do not heat above about 350° F. is shown. The fan assembly includes a hollow tubular sleeve or casing 941 which is rectangular in cross-section. The sleeve 941 is preferably made up of opposed channel members 941*a*, 941*b*, the edges of which have opposed abutting flanges 942 bolted together by spaced bolts and nuts 944.

A motor 958 is secured in the inner end portion of the sleeve 958 and has an outwardly protruding motor shaft 943 protruding inwardly, perpendicularly to the wall 924. The end of shaft 943 is provided with a rotary or bladed propeller 945 which includes a collar 946 secured to a hub 947 and blades 948 which radiate from the hub 947. In front of the fan 945 is a protective screen 970 supported by the walls of the housing 920.

The outer end of sleeve 941 protrudes through a side wall or roof wall 924 and is supported in place by angle iron brackets 952 and 953. Since the outer end of sleeve 941 is open to the ambient air, the rotation of the fan 945 by motor 958 will generate a draft through the sleeve 943, through the motor 958 and into the interior of the housing 920. This flow of air through motor 958 keeps the motor 958 cool.

A feature of the invention is the ability to provide temperature zones within a single oven. This is accomplished by using independent temperature controls on the steam coils or the gas or oil burner. The benefit of being able to zone the oven is that the most efficient rate of heat transfer for a specific portion of the cure cycle can be provided.

In addition to zoning the temperature, the velocity at which the air is impinged on the processed part or object can also be zoned by varying the RPM's of the fans through out the length of the oven.

I have found from actual tests that the heat transfer ov the ovens discussed above are from 5 to 10 times greater of faster than the heat transfer of ovens with only limited circulation. Thus, unusually fast drying of surfaces of objects are achieved. Through the high velocity of air delivered by the fans against the objects, the boundry layer is minimized and the solvent of paints is quite rapidly removed from the paint so that the painted surfaces are quite rapidly dried.

It will be understood that while I have disclosed the use of steam coils and the use of gas or oil burners, electric heating coils may be used in place of the steam coils, if desired and any combination of steam, electric, oil or gas heating may be employed, if desired.

It will be obvious to those skilled in the art that many variations may be made in the embodiments here chosen for the purpose of illustrating the present invention and full result may be had to the doctrine of equivalents without departing from the scope of the present invention as defined by the appended claims.

What is claimed is:

1. An oven for drying objects passed along a prescribed path therethrough, comprising:

(a) A housing having an entrance and exit and an open interior therebetween for forming a continuous path of travel through which successive objects to be dried are passed along said prescribed path from the entrance to the exit;

(b) a plurality of fans disposed successively along the length of said path, each of said fans having a hub and circumferentially spaced radial blades extending from said hub for rotating to generate a circulation of air, said blades being disposed generally in planes approximately parallel to and adjacent to said prescribed path, said fans being spaced from the walls and spaced from each other, said fans being disposed so as to circulate air in a circular flow of air over a portion of said path, the flow of air being from one side of the fan around to the other side of such fan, the spacing of said fans being such that air flows from successive fans respectively to impinge on objects at successive locations along said path of travel.

(c) heating means for delivering heat to the circulated air as it is directed in its path so that the air is progressively heated before being delivered toward said path of travel.

2. The oven defined in claim 1 in which each of said fans is spaced from an adjacent wall of said housing by a distance of from about three feet to about six feet.

3. The oven defined in claim 1 including additional fans substantially identical to said fan, said fans being disposed in spaced relationship to each other and to said fan, the axes of the shafts of said fan and said fans being parallel to each other.

4. The oven defined in claim 1 wherein said blades are disposed in a common plane on one side of and parallel to said path and are spaced longitudinally from each other along said path.

5. The oven defined in claim 3 wherein said fan and said fans are in a longitudinal row and have blades in a common plane and wherein said heating means includes heat exchangers disposed on opposite sides of said rows at about the plane of said blades.

6. The oven defined in claim 1 including exhaust means for exhausting air from the interior of said housing, said exhaust means including an exhaust duct and having its mouth opening into the interior of said housing and a blower for withdrawing air from said exhaust duct and discharging the same to the exterior of said housing.

7. Process of drying objects comprising:

(a) passing said objects successively along a prescribed path through the open interior of a housing;

(b) disposing a plurality of fans in succession adjacent to the path of travel for directing successive blasts of air from the front sides of said fans toward successive portions of said path of travel so as to contact each of said objects successively with such blasts of air during the travel of said objects along said path;

(c) directing said air as return air to the back sides of said fans, for redirection as blasts of air by said fans; and (d) heating the returned air after it has been directed toward said path of travel and before said air has reached the back side of said fans for redirection.

8. The process defined in claim 7 in which a portion of said air is progressively removed from said interior.

9. The process defined in claim 8 in which the step of heating said air includes introducing exterior air from the exterior of said housing into the interior of said housing and adjacent to the back sides of said fans for comingling with the return air, and heating the air from the exterior as it is fed toward the back sides of said fans.

10. An oven for drying objects comprising:

(a) a housing having an interior forming an open path of travel through which objects to be dried are passed along said path of travel;

(b) fan means disposed at spaced intervals adjacent to said path for respectively directing air against said objects at spaced intervals along said path of travel;

(c) spaced heating means along a side of said path of travel for heating the air delivered by said fan means; and (d) control means for individually, respectively controlling the speed of each fan means.

11. In an oven for drying objects disposed therein, a housing having a wall and defining an interior through which objects to be dried pass, a fan assembly carried by said wall, said fan assembly including a hollow tubular sleeve protruding through and supported by said wall, a bracket extending radially from the end of said sleeve externally of said wall, a motor on said bracket exteriorly of said wall, said sleeve being open for the passage of air therethrough, a shaft in said sleeve, belt means between said motor and said shaft so that said shaft is driven by said motor, bearings in said sleeve for supporting said shaft, said shaft protruding fom both ends of said sleeve, and a fan on the end of said shaft externally of the housing wall, and a fan on the end of said shaft and within said housing, said fan having a hub on said shaft and circumferentially spaced radial blades extending from said hub, the diameter of said blade being greater than the largest cross-sectional portion of the inside of said sleeve.

12. The oven defined in claim 11 wherein said sleeve is rectangular in cross section.

13. An oven for drying objects passed therethrough comprising:

(a) a housing having opposed side walls and a top wall forming a roof, the walls defining an interior within which said objects are disposed;

(b) heating means disposed within said interior of said housing for heating said interior; and (c) a fan assembly for one of the walls, said fan assembly having a fan disposed within the interior of said housing for directing air from said fan against said objects and for thereafter circulating the air in heat exchanging relationship to said heating means, a sleeve protruding through one of said walls, said sleeve being open throughout its length and fixed to said wall, said wall forming the major support for said sleeve, a shaft rotatably carried in said sleeve, the inner end of said shaft being connected to said fan for driving the same, bearing means carried by said sleeve for journalling said shaft for rotation about its axis, said sleeve being sufficiently open throughout its length that air passes from the exterior through said sleeve to the interior, passing said bearing means, and motor means externally of said housing for rotating said shaft.

14. The oven defined in claim 13 wherein said bearing means includes a pair of spaced bearings carried within said sleeve and journalling said shaft.

15. The oven defined in claim 13 including a motor mounting bracket fixed to the exterior end of said sleeve and extending sidewise therefrom, said motor being mounted on said motor mounting bracket and means exending between said motor and said shaft for driving said shaft from said motor.

16. The oven defined in claim 13 or claim 2 wherein said one of said walls is the side wall of said housing and said sleeve extends essentially perpendicular to said wall.

17. An oven for drying objects comprising:

(a) a housing having an essentially open interior through which objects to be dried are passed along a path of travel;

(b) fan means disposed at spaced intervals along said path of travel for respectively directing air against said objects at successive locations along said path;

(c) spaced heating means along a side of said path of travel for heating the air delivered by said fan means; and (d) control means for individually, respectively controlling the amount of heat delivered to the air by said heating means.

* * * * *